US007977895B2

(12) United States Patent
Yamada

(10) Patent No.: US 7,977,895 B2
(45) Date of Patent: Jul. 12, 2011

(54) PERTURBATION DEVICE FOR CHARGED PARTICLE CIRCULATION SYSTEM

(75) Inventor: Hironari Yamada, Oumihachiman (JP)

(73) Assignees: Photon Production Laboratory Ltd., Oumihachiman-shi (JP); Hironari Yamada, Oumihachiman-shi (JP)

( * ) Notice: Subject to any disclaimer, the term of this patent is extended or adjusted under 35 U.S.C. 154(b) by 472 days.

(21) Appl. No.: 12/294,727

(22) PCT Filed: Mar. 27, 2007

(86) PCT No.: PCT/JP2007/056496

§ 371 (c)(1),
(2), (4) Date: Oct. 22, 2008

(87) PCT Pub. No.: WO2007/119538

PCT Pub. Date: Oct. 25, 2007

(65) Prior Publication Data

US 2010/0231335 A1 Sep. 16, 2010

(30) Foreign Application Priority Data

Mar. 27, 2006 (JP) ..... 2006-085938

(51) Int. Cl.
*H05H 15/00* (2006.01)

(52) U.S. Cl. ..... 315/503; 335/210

(58) Field of Classification Search ..... 315/500–507; 335/209–214

See application file for complete search history.

(56) References Cited

U.S. PATENT DOCUMENTS 5,198,674 A * 3/1993 Underwood ..... 250/396 ML
5,557,178 A * 9/1996 Talman ..... 315/501
7,634,062 B2 * 12/2009 Tanaka et al. ..... 378/137
7,880,146 B2 * 2/2011 Johnstone ..... 250/396 R

FOREIGN PATENT DOCUMENTS

JP 2006-244879 9/2006

OTHER PUBLICATIONS

Novel X-Ray Source Based on a Tabletop Synchrotron and its Unique Features, Hironari Yamada, Ritsumeikan University, English Abstract Included.

Injection System of Compact SR Light Source "Aurora", Takeshi Takayama, et al., English Abstract included.

* cited by examiner

*Primary Examiner* — Don P Le

(74) *Attorney, Agent, or Firm* — Rankin, Hill & Clark LLP

(57) ABSTRACT

A perturbation device for a charged particle circulation system, capable of readily generating a distribution profile of a perturbation magnetic field, is provided. By partially superposing a perturbation magnetic field on a main magnetic field for circulating charged particles, perturbation is produced in trajectories of the charged particles. Then, the charged particles that have been injected into the charged particle circulation system are captured into a stable circular closed orbit. Using a leakage magnetic field formed of a magnetic field generated by magnetic field generation devices, each including a high-frequency coil, the perturbation magnetic field is generated.

15 Claims, 10 Drawing Sheets

PERTURBATOR MAGNETIC FIELD STRENGTH DISTRIBUTION DIAGRAM

PERTURBATION DEVICE FOR CHARGED PARTICLE CIRCULATION SYSTEM

TECHNICAL FIELD

The present invention relates to a perturbation device for a charged particle circulation system, which produces perturbation in trajectories of charged particles by partially superposing a perturbation magnetic field on a main magnetic field for circulating the charged particles, and captures the charged particles, which have been injected into the charged particle circulation system, into a stable circular closed orbit.

BACKGROUND ART

As the charged particle circulation system, a synchrotron or the like is known. As the synchrotron, there is the small-size synchrotron which is reduced in size to a diameter of approximately 60 cm, for example. The small-size synchrotron comprises a perturbation device for a charged particle circulation system, which captures the charged particles injected into the charged particle circulation system into a stable circular closed orbit. The perturbation device partially superposes a perturbation magnetic field on a main magnetic field for circulating charged particles so that perturbation is produced in the trajectories of the charged particles. The perturbation device is referred to as a "perturbator".

The charged particle circulation system such as the synchrotron further comprises a high-frequency acceleration cavity arranged on the stable circular closed orbit. The high-frequency acceleration cavity accelerates the charged particles that circulate in the stable circular closed orbit, after the perturbation device such as the perturbator has produced perturbation in the stable circular orbit and captured the charged particles injected into the charged particle circulation system into the stable circular orbit.

In the paper entitled "Novel X-ray Generated by Tabletop Synchrotron "MIRRORCLE-20" (Nonpatent Document 1), presented by Hironari Yamada in "Journal of the Japanese Society for Synchrotron Radiation Research", Vol. 15, No. 3, pp. 15-27, and in the paper entitled "Injection System of Compact SR Light Source "AURORA" Single Body Superconducting Ring" (Nonpatent Document 2), presented by Takeshi Takayama et al. in "Sumitomo Heavy Industries Technical Review", Vol. 1.39, No. 116, August 1991 pp. 11-18, for example, a perturbation device is described. The perturbation devices described in these papers, partially superpose a perturbation magnetic field on a main magnetic field for circulating charged particles in a synchrotron, so that perturbation is produced in the trajectory of the charged particles and the charged particles injected into the synchrotron are captured into a stable circular orbit.

A relationship between the synchrotron and the perturbation device will be described, using FIGS. 9 and 10. FIG. 9 simulatively illustrates that the perturbation device and a high-frequency acceleration cavity are arranged on the stable circular closed orbit of the synchrotron. FIG. 10 simulatively illustrates that injected charged particles are circulating in the stable circular closed orbit.

FIG. 9 simulatively illustrates that a perturbation device 1 which is constituted by the perturbator and a high-frequency acceleration cavity 3 are arranged on a stable circular closed orbit 5 of the synchrotron. FIG. 9 also shows the trajectories of the charged particles that have been perturbated by the perturbator while being injected into the synchrotron. FIG. 10 simulatively illustrates that the injected charged particles or an accumulating electron beam in the form of electron bunches (group of electrons) are circulating on the stable circular closed orbit 5. In these figures, reference numeral 7 denotes a central orbit that is present in the center of the stable circular closed orbit 5. Incidentally, in FIGS. 9 and 10, a main magnet that forms the orbit of circulating electrons and prevents diverge of the electron beam is omitted from the illustration.

This synchrotron uses a resonance injection method in which an injection trajectory is produced without influencing the accumulating electron beam. When an electron beam is injected using the resonance injection method, electrons are in a resonance state at the time of the injection, and betatron oscillation amplitudes of the electrons have become large. If a high-frequency acceleration voltage is applied to the high-frequency acceleration cavity 3 when the betatron oscillation amplitudes of the electrons are large, the electrons will scatter and jump out of the stable circular closed orbit 5.

Then, the electrons (charged particles) by the high-frequency acceleration cavity 3 is not actively accelerated until betatron oscillation of the electrons (charged particles) is reduced and the electrons (charged particles) circulate on the stable circular closed orbit 5, after perturbation has been produced in the stable circular closed orbit 5 by the perturbation device 1 and the electrons (charged particles) have been captured into the stable circular closed orbit 5.

The size of the electron bunch (group of electrons) is smaller when energies of the electrons are high. When the energies of the electrons are low, the size of the electron bunch increases. In recent years, the synchrotron has come to be used when the energies of the electrons are low. Non-patent Document 1: Paper Entitled "Novel X-ray Generated by Tabletop Synchrotron "MIRRORCLE-20", presented by Hironari Yamada in "Journal of the Japanese Society for Synchrotron Radiation Research", vol. 15, No. 3, pp. 15-27.

Non-patent Document 2: Paper Entitled "Injection System of Compact SR Light Source "AURORA" Single Body Superconducting Ring", presented by Takeshi Takayama et al. in "Sumitomo Heavy Industries Technical Review", Vol. 1.39, No. 116, August 1991 pp. 11-18.

SUMMARY OF INVENTION

Technical Problem

If the synchrotron is used when the energies of the electrons are low and the size of the electron bunch accordingly increases, the charged particles cannot be entirely captured into the stable circular closed orbit because a perturbation range of the conventional perturbation device is narrow.

When the size of the electron bunch increases, the electron bunch on the stable circular closed orbit may strike a conductor portion of the perturbation device 1 in the conventional perturbation device, and the charged particles that have struck the conductor portion may disappear.

An object of the present invention is to provide a perturbation device for a charged particle circulation system capable of readily generating a desired distribution profile of a perturbation magnetic field.

Another object of the present invention is to provide a perturbation device for a charged particle circulation system capable of accurately generating a desired distribution profile of the perturbation magnetic field.

A further object of the present invention is to provide a perturbation device for a charged particle circulation system capable of readily capturing charged particles into a stable circular closed orbit even if the size of an electron bunch increases.

Another object of the present invention is to provide a perturbation device for a charged particle circulation system capable of preventing an electron bunch from striking the perturbation device even if the size of the electron bunch increases.

Solution of Problem

The present invention aims at improvement of a perturbation device for a charged particle circulation system that partially superposes a perturbation magnetic field on a main magnetic field for circulating charged particles, thereby producing perturbation in trajectories of the charged particles and then capturing the charged particles that have been injected into the charged particle circulation system, into a stable circular closed orbit. The perturbation device herein has a configuration in which deformation (perturbation) in the stable circular closed orbit is produced by the perturbation magnetic field, thereby facilitating the charged particles to be captured into the stable circular closed orbit. The stable circular closed orbit may be circular or noncircular. In the description of this application, a direction in which the charged particles move on the stable circular closed orbit is referred to as a peripheral direction. A direction that extends from the stable circular closed orbit to the center of the stable circular closed orbit and a direction that extends from the center of the stable circular closed orbit to the stable circular closed orbit are referred to as a radial direction. Then, a direction orthogonal to the peripheral direction and the radial direction is referred to as an orthogonal direction.

In the perturbation device for a charged particle circulation system according to the present invention, the perturbation magnetic field is formed of a leakage magnetic field from a magnetic field generated by a magnetic field generation device comprising a high-frequency coil. When the perturbation magnetic field is formed of the leakage magnetic field from the magnetic field generated by the magnetic field generation device, a desired distribution profile of the perturbation magnetic field may readily be generated by altering a leakage distribution profile of the leakage magnetic field.

The high-frequency coil for generating the magnetic field has an opening portion that is opened toward a space where the perturbation magnetic field is to be generated, in order to generate the leakage magnetic field. Then, conductor end portions of the high-frequency coil face or are opposed to each other with the opening portion interposed therebetween and are inclined to determine a distribution profile of the magnetic field generated in the space by the leakage magnetic field. Assume that an inclination that determines the distribution profile of the magnetic field is given to the conductor end portions of the high-frequency coil or the conductor end portions are inclined so as to determine the distribution profile of the magnetic field, the distribution profile of the leakage magnetic field may be altered by changing the shape or an angle of the inclination, and the desired distribution profile of the perturbation magnetic field may readily and accurately be generated.

The structure of the high-frequency coil that generates the leakage magnetic field is arbitrary. A certain high-frequency coil, for example, includes a pair of internal conductors that face or are opposed to each other via a predetermined space through which a part of the stable circular closed orbit passes and an external conductor arranged outside the pair of internal conductors. The pair of internal conductors and the external conductor are electrically connected in series. Then, the magnetic field generated between the pair of internal conductors and the external conductor is leaked into the space between the pair of internal conductors to form the leakage magnetic field, and the perturbation magnetic field is thereby formed in the space. With such a structure, using the leakage magnetic field from the magnetic field generated by the magnetic generation device including the one high-frequency coil, the perturbation magnetic field may be generated between the pair of internal conductors. By altering the distribution profile of the leakage magnetic field, the distribution profile of the perturbation magnetic field may arbitrarily be determined.

More specifically, the pair of internal conductors and the external conductor are each configured so that the magnetic field is formed between the pair of internal conductors and the external conductor. The magnetic field thus formed surrounds the pair of internal conductors and the leakage magnetic field leaking out from the magnetic field enters into the space between the pair of internal conductors. Then, both end portions of each of the pair of internal conductors, located in a radial direction of the stable circular closed orbit, may be inclined. By inclining both end portions of each of the pair of internal conductors, the distribution profile of the perturbation magnetic field formed between the pair of internal conductors may readily be formed into a desired profile.

In this configuration, the external conductor is configured so that another two spaces where the charged particles may pass are formed and the another two spaces are located on both sides in the radial direction of the space formed in the pair of internal conductors. With the another two spaces formed, the charged particles may be prevented from striking the external conductor and being lost even if the trajectories of the charged particles have greatly been changed in the radial direction.

The magnetic field generation device may comprise first and second divided magnetic field generation devices each comprising a high-frequency coil. The first and second divided magnetic field generation devices are arranged apart from each other in the radial direction so that a space through which a part of the stable circular closed orbit passes is formed therebetween. Then, the first and second divided magnetic field generation devices are configured so that the leakage magnetic field is entered into the space, thereby forming the perturbation magnetic field in the space. Assume that the magnetic field generation device is constituted by the first and second divided magnetic field generation devices that are apart in the radial direction, as described above. Then, even if the size of an electron bunch increases, the electron bunch, the size of which has increased, may effectively be prevented from striking the magnetic field generation device.

Each of the first and second divided magnetic field generation devices includes an internal conductor and an external conductor arranged apart from each other and electrically connected in series. Then, the internal conductor and the external conductor are configured so that the magnetic field is formed between the internal conductor and the external conductor, and the leakage magnetic field is leaked from an opening portion formed in the external conductor and is opened in the radial direction. With this configuration, the magnetic field distribution profile of the perturbation field may be determined appropriately by determining the size and shape of the opening and the distance between the first and second divided magnetic field generation devices appropriately. For this reason, preferably, the external conductor used in each of the first and second divided magnetic field generation devices may include a pair of conductor end portions which are located both sides of the opening portion, and each of the pair of conductor end portions may be inclined.

The internal conductor may comprise a pair of divided internal conductors spaced in an orthogonal direction orthogonal to both the peripheral direction of the stable circular closed orbit and the radial direction of the stable circular closed orbit. The external conductor is formed so as to surround the pair of divided internal conductors with the opening portion formed therein. The opening portion is opened in the peripheral direction of the stable circular closed orbit and also is opened in the radial direction of the stable circular closed orbit. Then, preferably, the pair of divided internal conductors and the external conductor are positioned so that a gap formed between the pair of divided internal conductors and the opening portion are aligned in the radial direction. With this configuration, it will be less likely that the charged particles strike the internal conductors and the external conductor even if the trajectories of the charged particles greatly vary in the radial direction of the stable circular closed orbit.

When the first divided magnetic field generation device is arranged more inward in the radial direction of the stable circular closed orbit than the second divided magnetic field generation device, the first and second divided magnetic field generation devices may be configured as follows. The pair of divided internal conductors of the first divided magnetic field generation device may be constituted by a pair of circular arc-like conductive plates that extend along the peripheral direction and in the radial direction, centering on the center of the stable circular closed orbit. The pair of circular arc-like conductive plates are located inside the stable circular closed orbit. The external conductor of the first divided magnetic field generation device may comprise a pair of circular arc-like conductive plates, a pair of conductive side plates, and a conductive coupling plate. The pair of circular arc-like conductive plates are located on both sides of the opening portion. The circular arc-like conductive plates are spaced in the orthogonal direction and extend in the peripheral direction, centering on the center of the stable circular closed orbit and also extend in the orthogonal direction. The pair of conductive side plates are located outside the pair of divided internal conductors. The conductive side plates are spaced in the orthogonal direction and extend in the peripheral direction and the radial direction. The circular arc-like conductive plate is provided at end portion of each of the pair of conductive side plates. The end portion of the conductive side plate is located outward in the radial direction. The conductive coupling plate couples end portions of the pair of conductive side plates located inward in the radial direction. The pair of divided internal conductors and the external conductor are coupled by a conductive plate at a position that does not interfere with passing charged particles.

Further, the pair of divided internal conductors of the second divided magnetic field generation device may be constituted by a pair of circular arc-like conductive plates that extend along the peripheral direction and in the radial direction, centering on the center of the stable circular closed orbit. The pair of circular arc-like conductive plates are located outside the stable circular closed orbit. In this configuration, the external conductor of the second divided magnetic field generation device may comprise a pair of circular arc-like conductive plates, a pair of conductive side plates, and a conductive coupling plate. The pair of circular arc-like conductive plates are located on both sides of the opening portion. The circular arc-like conductive plates are spaced in the orthogonal direction, and extend in the peripheral direction, centering on the center of the stable circular closed orbit and also extend in the orthogonal direction. The pair of conductive side plates are located outside the pair of divided internal conductors. The conductive side plates are spaced in the orthogonal direction and extend in the peripheral direction and the radial direction. The conductive coupling plate couples end portions of the pair of conductive side plates, which are located outward in the radial direction of the stable circular closed orbit. Then, the pair of divided internal conductors and the external conductor are coupled by a conductive short-circuit plate at a position that do not interfere with passing charged particles.

Since the first and second divided magnetic field generation devices are configured as described above, the first and second divided magnetic field generation devices are considered that the first divided magnetic field generation device and the second divided magnetic field generation device are electrically connected in parallel. By flowing a high-frequency current through the external conductor from the internal conductor of each divided magnetic field generation device, a desired leakage magnetic field necessary for forming the perturbation magnetic field may be formed with a simple configuration.

The pair of divided internal conductors that comprise the internal conductor of the first divided magnetic field generation device may be electrically connected to the pair of divided internal conductors of the second divided magnetic field generation device in series, and the external conductor of the first divided magnetic field generation device and the external conductor of the second divided magnetic field generation device may be electrically connected in series, without connecting the internal conductors and the external conductor of the first divided magnetic field generation device by the conductive short-circuit plate. In this configuration, the first divided magnetic field generation device and the second divided magnetic field generation device are electrically connected in series. In this configuration as well, the necessary leakage magnetic field may be generated.

Only one of the first and second divided magnetic field generation devices may be used as an independent magnetic field generation device comprising a high-frequency coil.

DESCRIPTION OF EMBODIMENT

Embodiments of a perturbation device for a charged particle circulation system according to the present invention will now be described in detail with reference to drawings.

The perturbation device for a charged particle circulation system according to the present invention captures charged particles, which have been injected into the charged particle circulation system, into a stable circular closed orbit. The perturbation device partially superposes a perturbation magnetic field on a main magnetic field for the circulating the charged particles, so that perturbation is produced in trajectories of the charged particles.

Figure 1:
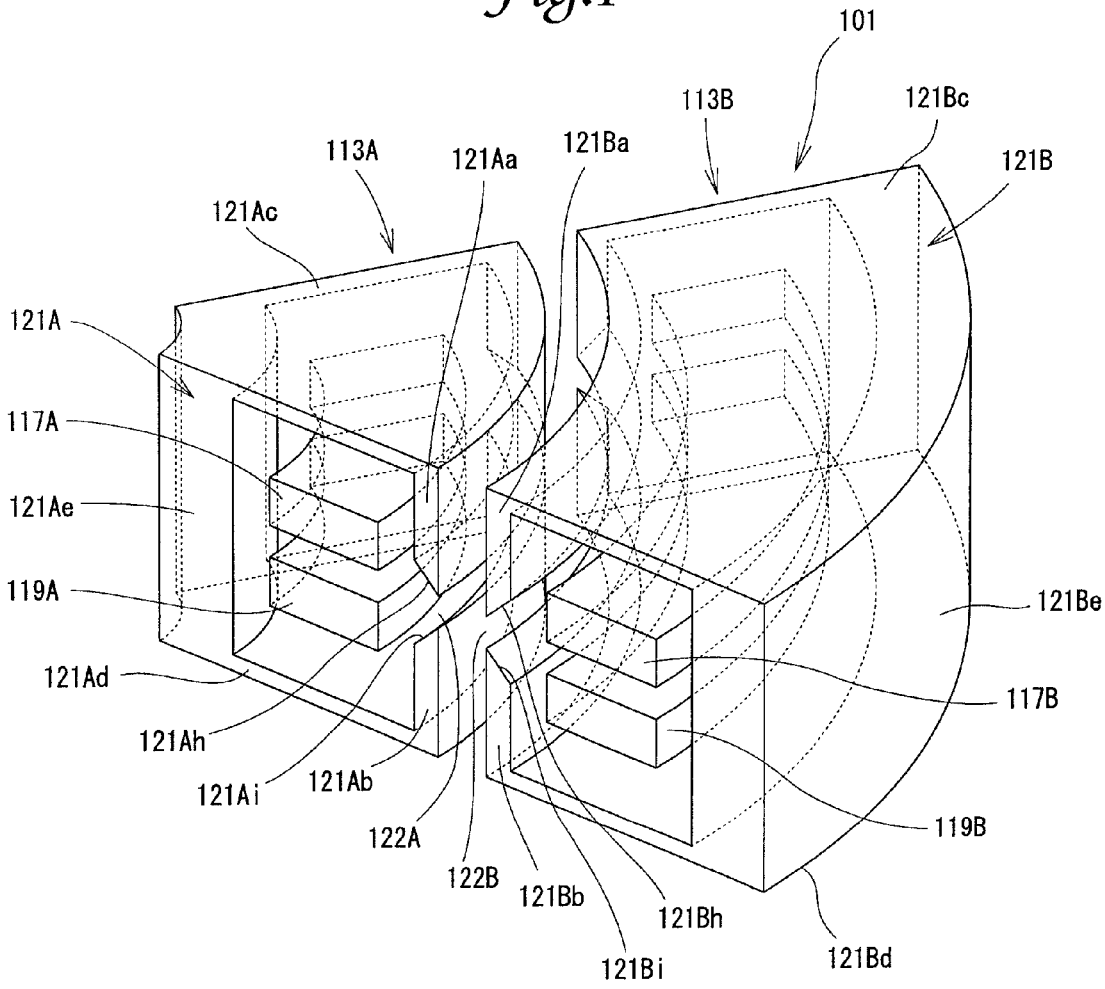
FIG. 1 is a perspective view of a first embodiment of a perturbation device for a charged particle circulation system according to the present invention as seen from one side of the device so that the inside of the perturbation device may be seen.
Figure 2:
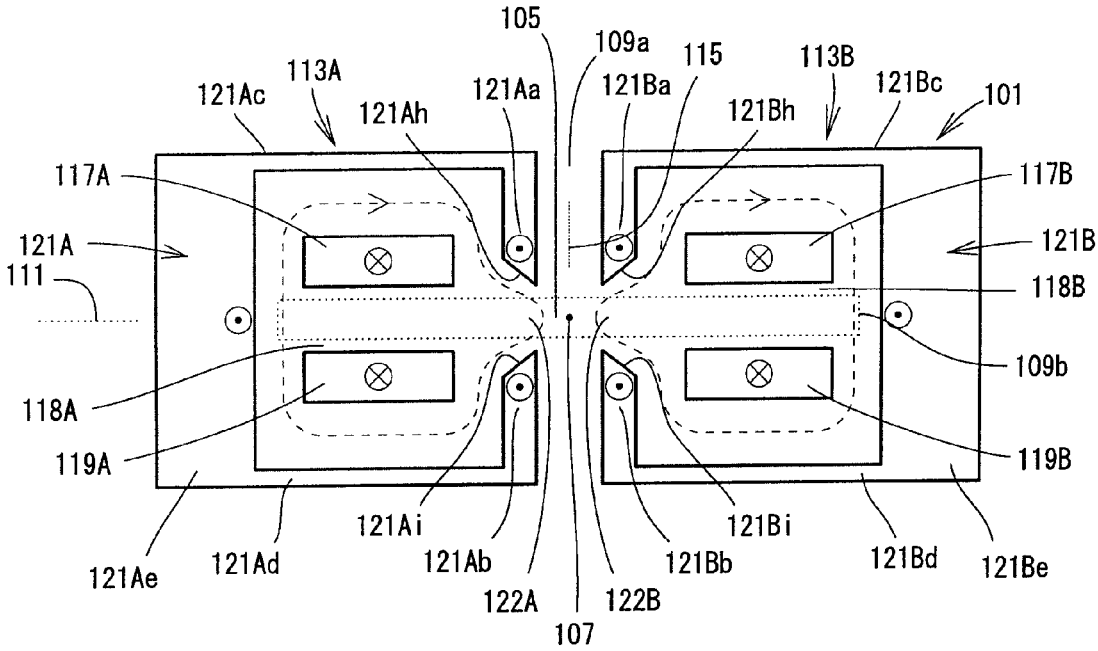
FIG. 2 is an end surface view showing one end of the perturbation device for a charged particle circulation system of the first embodiment in a peripheral direction.
Figure 3:
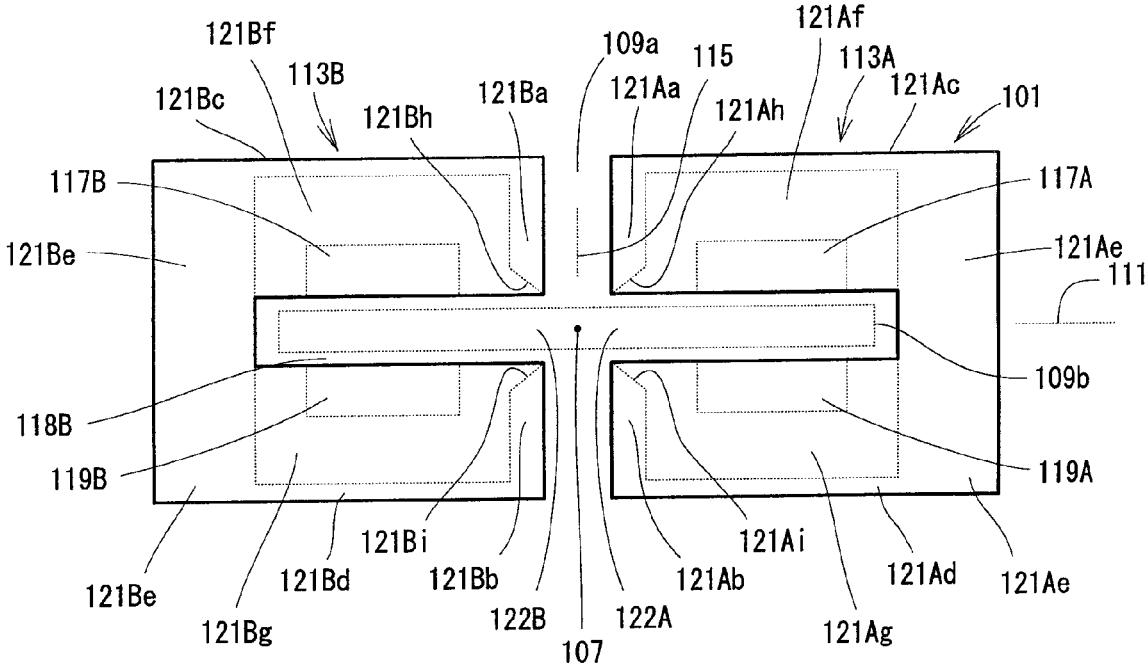
FIG. 3 is an end surface view showing the other end of the perturbation device for a charged particle circulation system of the first embodiment in the peripheral direction.
Figure 4:
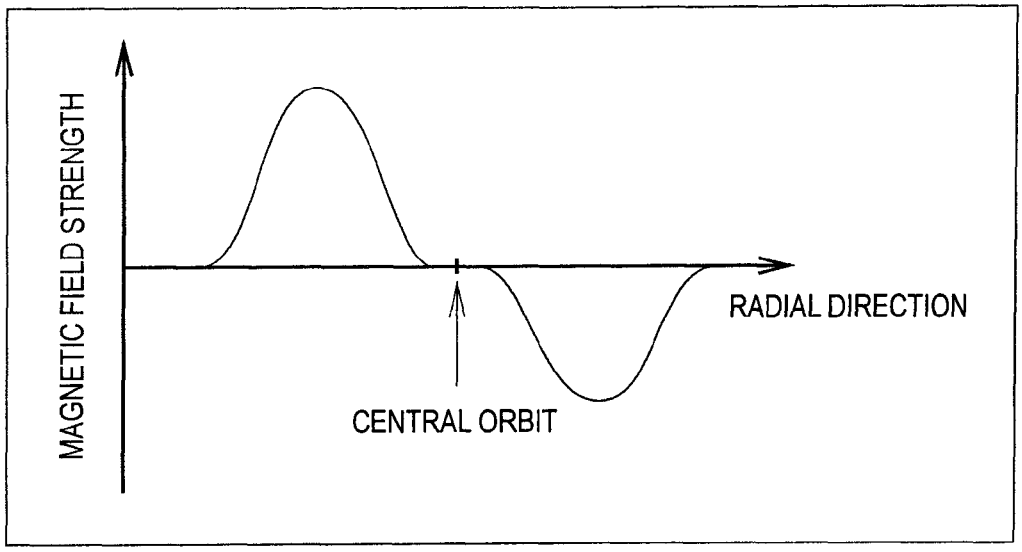
FIG. 4 is a graph showing an example magnetic field strength distribution of a perturbation magnetic field generated by a pair of divided magnetic field generation devices.
Figure 9:
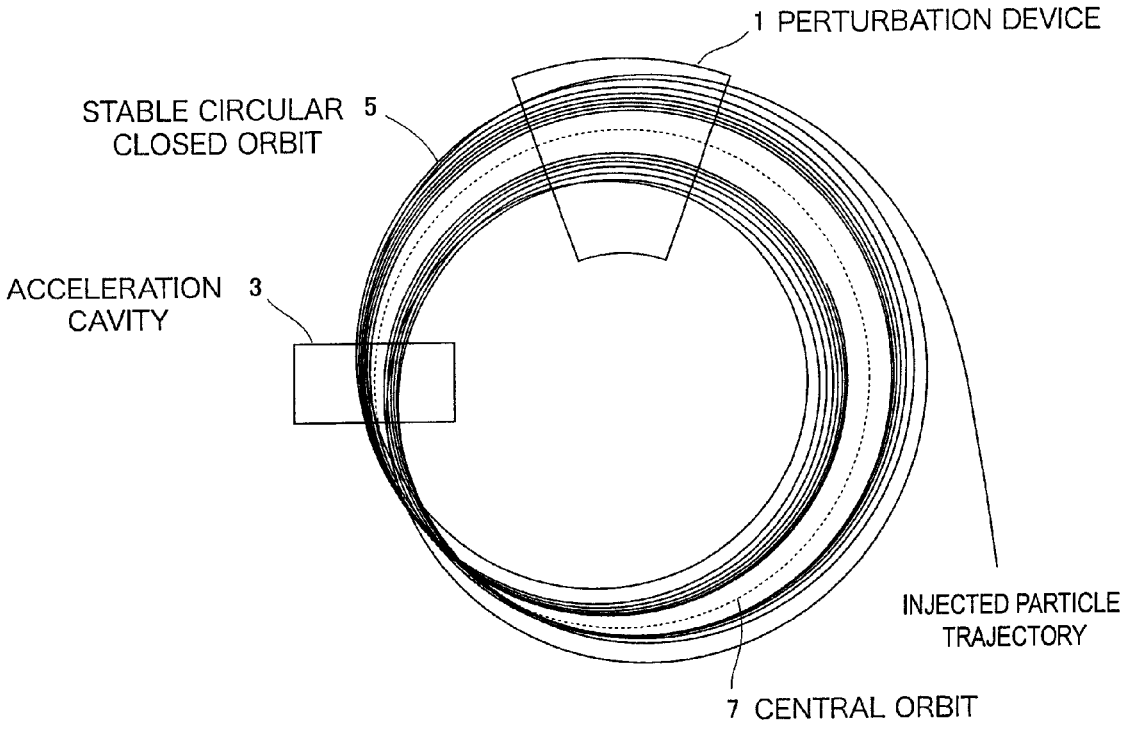
FIG. 9 simulatively illustrates that a perturbation device and a high-frequency acceleration cavity are arranged on a stable circular closed orbit of a synchrotron in the prior art.
Figure 10:
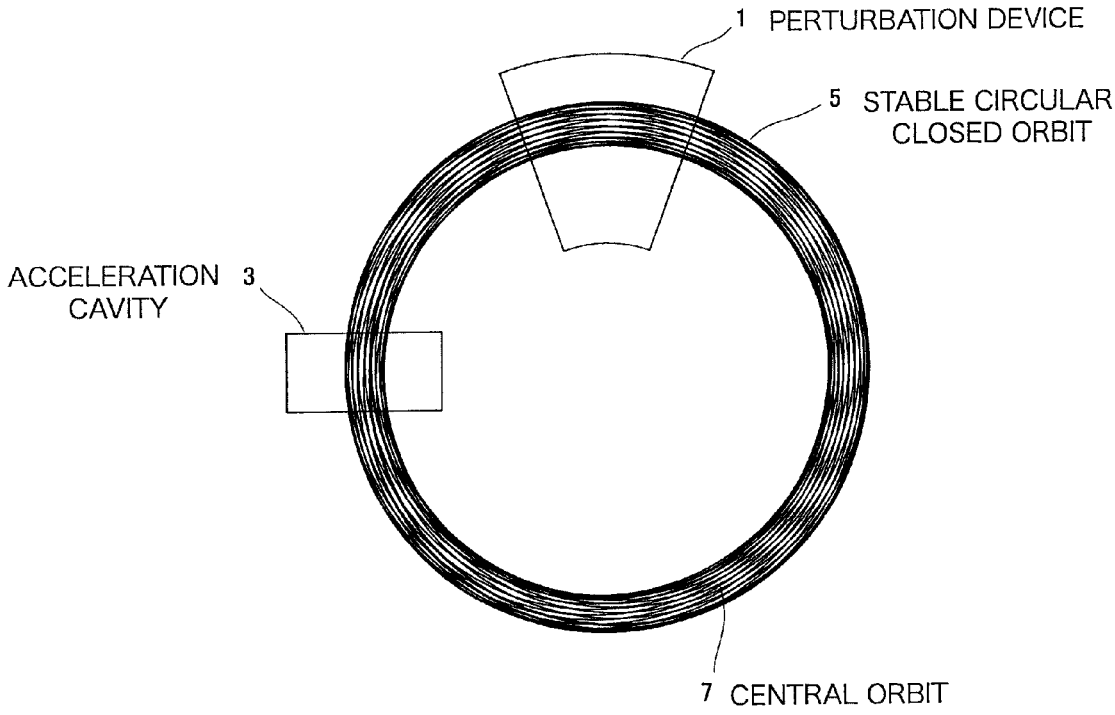
FIG. 10 simulatively illustrates that injected charged particles circulate on the stable circular closed orbit in the prior art.

FIGS. 1 through 4 show a first embodiment of the perturbation device for a charged particle circulation system according to the present invention. FIG. 1 is a perspective view of the perturbation device for a charged particle circulation system of the first embodiment, as seen from one side of the device. FIG. 2 is an end surface view showing one end of the perturbation device for a charged particle circulation system of the embodiment in a peripheral direction. FIG. 3 is an end surface view showing the other end of the perturbation device for a charged particle circulation system of the embodiment in the peripheral direction. FIG. 4 is a graph showing an example magnetic field strength distribution of a perturbation magnetic field generated by first and second divided magnetic field generation devices. Reference numerals obtained by adding 100 to components in FIGS. 9 and 10 are used for components corresponding to those in FIGS. 9 and 10 and illustrated.

A perturbation device 101 for a charged particle circulation system in this embodiment includes a first divided magnetic field generation device 113A and a second divided magnetic field generation device 113B arranged apart in a radial direction 111 of a stable circular closed orbit 105 so that a space 109*a* (shown in FIG. 2) is formed between the first and second divided magnetic field generation devices 113A and 113B. In the space 109*a*, the perturbation magnetic field is formed. Each of the first and second divided magnetic field generation devices 113A and 113B is formed of a high-frequency coil. The first and second divided magnetic field generation devices 113A and 113B are formed of a non-magnetic metal such as aluminum. A half-pulse current of a high frequency of 4 to 5 MHz is flowed through the first and second divided magnetic field generation devices 113A and 113B, thereby generating a magnetic field.

The first divided magnetic field generation device 113A is positioned more inward in the radial direction of the stable circular closed orbit 105 or a central orbit 107 than the second divided magnetic field generation device 113B.

The first divided magnetic field generation device 113A includes a pair of divided internal conductors 117A and 119A and an external conductor 121A. The pair of divided internal conductors 117A and 119A are located in a moving direction of charged particles that travel in a direction of the central orbit 107 or a peripheral direction of the stable circular closed orbit 105 and an orthogonal direction 115 that crosses the radial direction 111 at right angle. A passable range 109*b* is interposed between the pair of divided internal conductors 117A and 119A. The external conductor 121A is arranged so as not to cross the passable range 109*b* and is electrically connected to the divided internal conductors 117A and 119A. The pair of divided internal conductors 117A and 119A constitute an internal conductor of the first divided magnetic field generation device 113A. Then, the external conductor 121 is formed so as to surround the pair of divided internal conductors 117A and 119A with an opening portion 122A formed therein. The opening portion 122A is opened on both sides in the peripheral direction of the stable circular closed orbit 105 and is also opened in the radial direction. Then, the positional relationship among the pair of divided internal conductors 117A and 119A and the external conductor 121A is determined so that a gap 118A formed between the pair of divided internal conductors 117A and 119A and the opening portion 122A are aligned in the radial direction.

In this embodiment, the pair of divided internal conductors 117A and 119A of the first divided magnetic field generation device 113A comprise a pair of circular arc-like conductive plates located inside the central orbit 107. The pair of divided internal conductors 117A and 119A extend in the radial direction 111 and along the central orbit 107, centering on the center of the stable circular closed orbit or the central orbit 107. The external conductor 121A comprises a pair of circular arc-like conductive plates 121Aa and 121Ab, a pair of conducting side plates 121Ac and 121Ad, and a conductive coupling plate 121Ae. The circular arc-like conductive plates 121Aa and 121Ab are located on both sides of the opening 122A are spaced in the orthogonal direction. The circular arc-like conductive plates 121Aa and 121Ab extend in the orthogonal direction and the peripheral direction, centering on the center of the stable circular closed orbit 105. The conductive side plates 121Ac and 121Ad are located outside the pair of divided internal conductors 117A and 119A and are spaced in the orthogonal direction. The conductive side plates 121Ac and 121Ad extend in the peripheral direction and the radial direction. At end portions of the pair of conductive side plates 121Ac and 121Ad located outward in the radial direction, the circular arc-like conductive plates 121Aa and 121Ab are provided. Further, the conductive coupling plate 121Ae couples end portions of the pair of conductive side plates 121Ac and 121Ad located inward in the radial direction. The pair of divided internal conductors and the external conductor are coupled by conductive short-circuit plates 121Af and 121Ag at positions that do not interfere with passing charged particles. End surfaces of the pair of conductive plates 121Aa and 121Ab of the first divided magnetic field generation device 113A are formed into inclined surfaces 121Ah and 121Ai. In this embodiment, the pair of divided internal conductors 117A and 119A, external conductor 121A, and conductive short-circuit plates 121Af and 121Ag constitute the high-frequency coil.

The second divided magnetic field generation device 113B similarly includes a pair of divided internal conductors 117B and 119B and an external conductor 121B. The pair of divided internal conductors 117B and 119B is located in the moving direction of the charged particles that travel in the direction of the central orbit 107 or the peripheral direction of the stable circular closed orbit 105 and the orthogonal direction 115 that crosses the radial direction 111 at right angle. The passable range 109*b* is interposed between the pair of divided internal conductors 117B and 119B. The external conductor 121B is arranged not to cross the passable range 109*b* and is electrically connected to the divided internal conductors 117B and 119B. The pair of divided internal conductors 117B and 119B constitute an internal conductor of the second divided magnetic field generation device 113B. Then, the external conductor 121B is formed so as to surround the pair of divided internal conductors 117B and 119B with an opening portion 122B formed therein. The opening portion 122B is opened on both sides in the peripheral direction of the stable circular closed orbit 105 and is also opened inward in the radial direction. Then, the positional relationship among the pair of divided internal conductors 117B and 119B and the external conductor 121B is determined so that a gap 118B formed between the pair of divided internal conductors 117B and 119B and the opening portion 122B are aligned in the radial direction.

In this embodiment, the pair of the divided internal conductors 117B and 119B of the second divided magnetic field generation device 113B comprise a pair of circular arc-like conductive plates that extend in the radial direction 111 and along the central orbit 107, centering on the center of the stable circular closed orbit 105. The pair of circular arc-like conductive plates are located outside the central orbit 107. The external conductor 121B comprises a pair of circular arc-like conductive plates 121Ba and 121Bb, a pair of conductive side plates 121Bc and 121Bd, and a conductive coupling plate 121Be. The circular arc-like conductive plates 121Ba and 121Bb are located on both sides of the opening portion 122B and are spaced in the orthogonal direction. The circular arc-like conductive plates 121Ba and 121Bb extend in the peripheral direction, centering on the center of the stable circular closed orbit 105 and also extend in the orthogonal direction. The conductive side plates 121Bc and 121Bd are located outside the pair of divided internal conductors 117B and 119B and are spaced in the orthogonal direction. The conductive side plates 121Bc and 121Bd extend both in the peripheral and radial directions. At end portions of the conductive side plates 121Bc and 121Bd located inward in the radial direction, the circular arc-like conductive plates 121Ba and 121Bb are provided. Further, the conductive coupling plate 121Be couples end portions of the conductive side plates 121Bc and 121Bd located outward in the radial direction. The pair of divided internal conductors and the external conductor are coupled by a pair of conductive short-circuit plates 121Bf and 121Bg at positions that do not interfere with passing charged particles. End surfaces of the pair of conductive plates 121Ba and 121Bb of the second divided magnetic field generation device 113B are formed into inclined surfaces 121Bh and 121Bi. In this embodiment, the pair of divided internal conductors 117B and 119B, external conductor 121B, and conductive short-circuit plates 121Bf and 121Bg constitute the high-frequency coil.

The end surfaces of the pair of the conductive plates 121Aa and 121Ab that face or are opposed to each other with the opening portion 122A of the first divided magnetic field generation device 113A interposed therebetween are inclined so that a distance between the two end surfaces increases more as the end surfaces are separated more from the opening portion 122A. The end surfaces of the pair of the conductive plates 121Ba and 121Bb that face each other with the opening portion 122B of the second divided magnetic field generation device 113B interposed therebetween are inclined so that a distance between the two end surfaces increases more as the end surfaces are separated more from the opening portion 122B. Accordingly, these end surfaces constitute the inclined surfaces 121Ah and 121Ai and the inclined surfaces 121Bh and 121Bi.

With respect to a profile of a magnetic field distribution formed over the space 109*a* between the first divided magnetic field generation device 113A and the second divided magnetic field generation device 113B, a space between the pair of the conductive plates 121Aa and 121Ab, and a space between the pair of the conductive plates 121Ba and 121Bb, a magnetic field strength is zero in the center of the space 109*a*, as shown in FIG. 4. Then, polarities of the magnetic field strength are reversed between both sides of the center in the radial direction.

A main magnetic field not shown is given to the first divided magnetic field generation device 113A and the second divided magnetic field generation device 113B from the orthogonal direction 115 orthogonal to the radial direction 111 of the central orbit 107. A magnetic field strength distribution of this main magnetic field is determined so that the charged particles that have entered the stable circular closed orbit 105 collect on the central orbit 107 of the stable circular closed orbit 105 when the first divided magnetic field generation device 113A and the second divided magnetic field generation device 113B do not generate the perturbation magnetic field.

When the perturbation magnetic field is formed as described above, using the leakage magnetic field of the magnetic field generated by each of the first divided magnetic field generation device 113A and the second divided magnetic field generation device 113B, the distribution profile of the perturbation magnetic field may readily be formed into an arbitrary profile by altering a distribution profile of the leakage magnetic field.

Further, an inclination that determines the magnetic field distribution profile is given to the conductor ends of the external conductor that constitutes a portion of the high-frequency coil. Accordingly, by changing the inclination, the leakage distribution profile of the leakage magnetic field will alter. The distribution profile of the perturbation magnetic field may be thereby readily and accurately generated.

According to this embodiment, the gap 118A between the pair of the divided internal conductors 117A and 119A, the gap 118B between the pair of the divided internal conductors 117B and 119B, the opening portion 122A between the pair of the conductive plates 121Aa and 121Ab, and the opening portion 122B between the pair of the conductive plates 121Ba and 121Bb are aligned in one direction. Thus, even if the trajectories of charged particles greatly vary in the radial direction, the charged particles may readily be captured into the stable circular closed orbit. Further, the first divided magnetic field generation device 113A and the second divided magnetic field generation device 113B are arranged apart in the radial direction. Thus, a phenomenon may be prevented, in which an electron bunch that is long in the orthogonal direction strikes the first divided magnetic field generation device 113A and the second divided magnetic field generation device 113B and then the charged particles thereby disappear.

Figure 5:
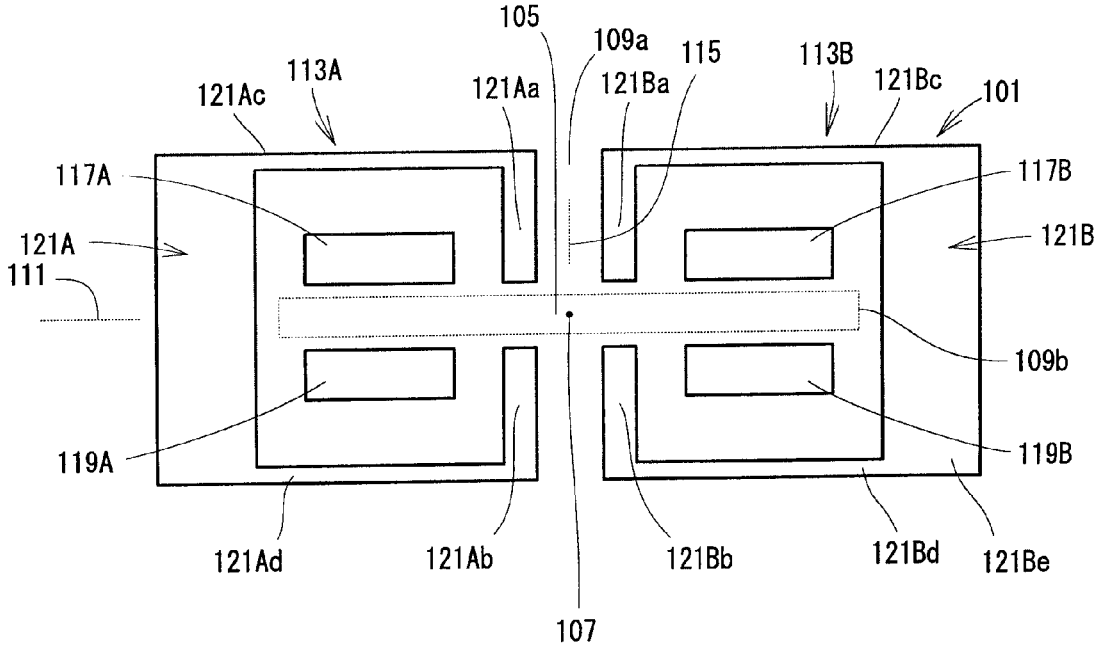
FIG. 5 is an end surface view showing one end of a perturbation device for a charged particle circulation system of a variation example of the first embodiment in the peripheral direction.

The perturbation device 101 may be of a configuration similar to that in FIGS. 1 through 4 described above but does not include the inclined surfaces 121Ah and 121Ai at the end portions of the pair of the conductive plates 121Aa and 121Ab and the inclined surfaces 121Bh and 121Bi at the end portions of the pair of the conductive plates 121Ba and 121Bb, as shown in FIG. 5.

Figure 6:
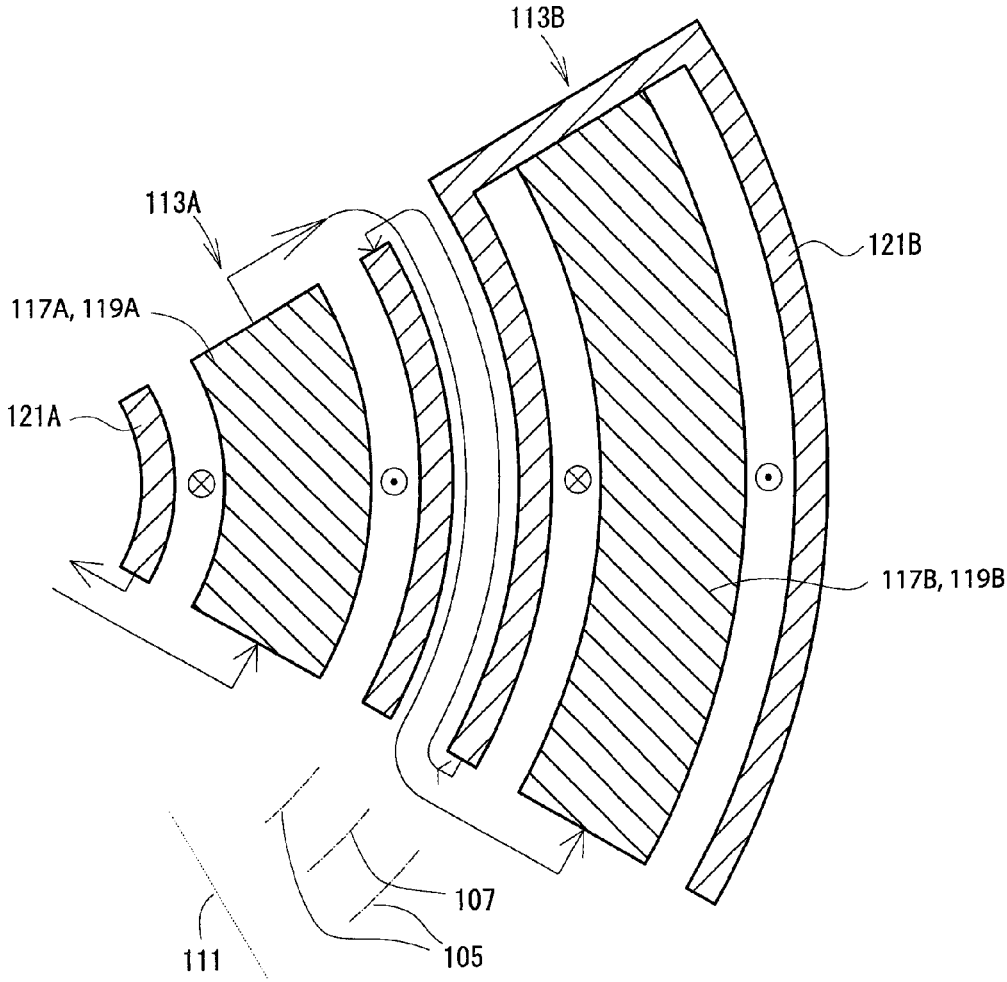
FIG. 6 explains a different example electrical connection between first and second divided magnetic field generation devices.

In the embodiment described above, the first divided magnetic field generation device 113A and the second divided magnetic field generation device 113B may be considered that they are electrically connected in parallel. By flowing a high-frequency current through the external conductor from the internal conductor of each divided magnetic field generation device, the leakage magnetic field necessary for forming the perturbation magnetic field is formed. However, as shown in FIG. 6, the pair of divided internal conductors 117A and 119A that constitute the internal conductor of the first divided magnetic field generation device 113A may be electrically connected to the pair of divided internal conductors 117B and 119B of the second divided magnetic field generation device 113B in series and the external conductor 121A of the first divided magnetic field generation device 113A and the external conductor 121B of the second divided magnetic field generation device 113B may be electrically connected in series, without connecting the internal conductors 117A and 119A of the first divided magnetic field generation device 113A and the external conductor 121A by the conductive short-circuit plates. In this configuration, the first divided magnetic field generation device 113A and the second divided magnetic field generation device 113B may be considered that they are electrically connected in series. With such an arrangement as well, the necessary leakage magnetic field may be generated. In FIG. 6, the same components as those shown in FIGS. 1 through 5 are given the same reference numerals as in FIGS. 1 through 5.

Figure 7:
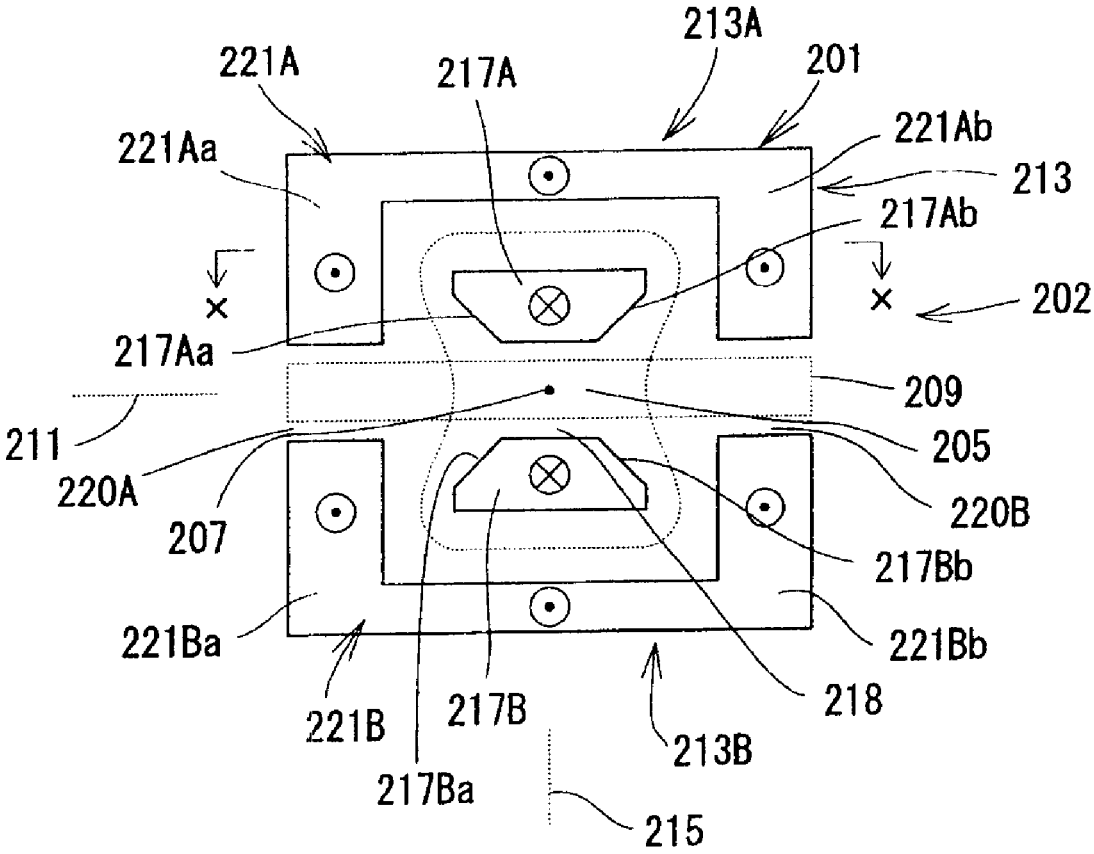
FIG. 7 is an end surface view of a second embodiment of a perturbation device for a charged particle circulation system according to the present invention as seen from one side of the device in a peripheral direction.
Figure 8:
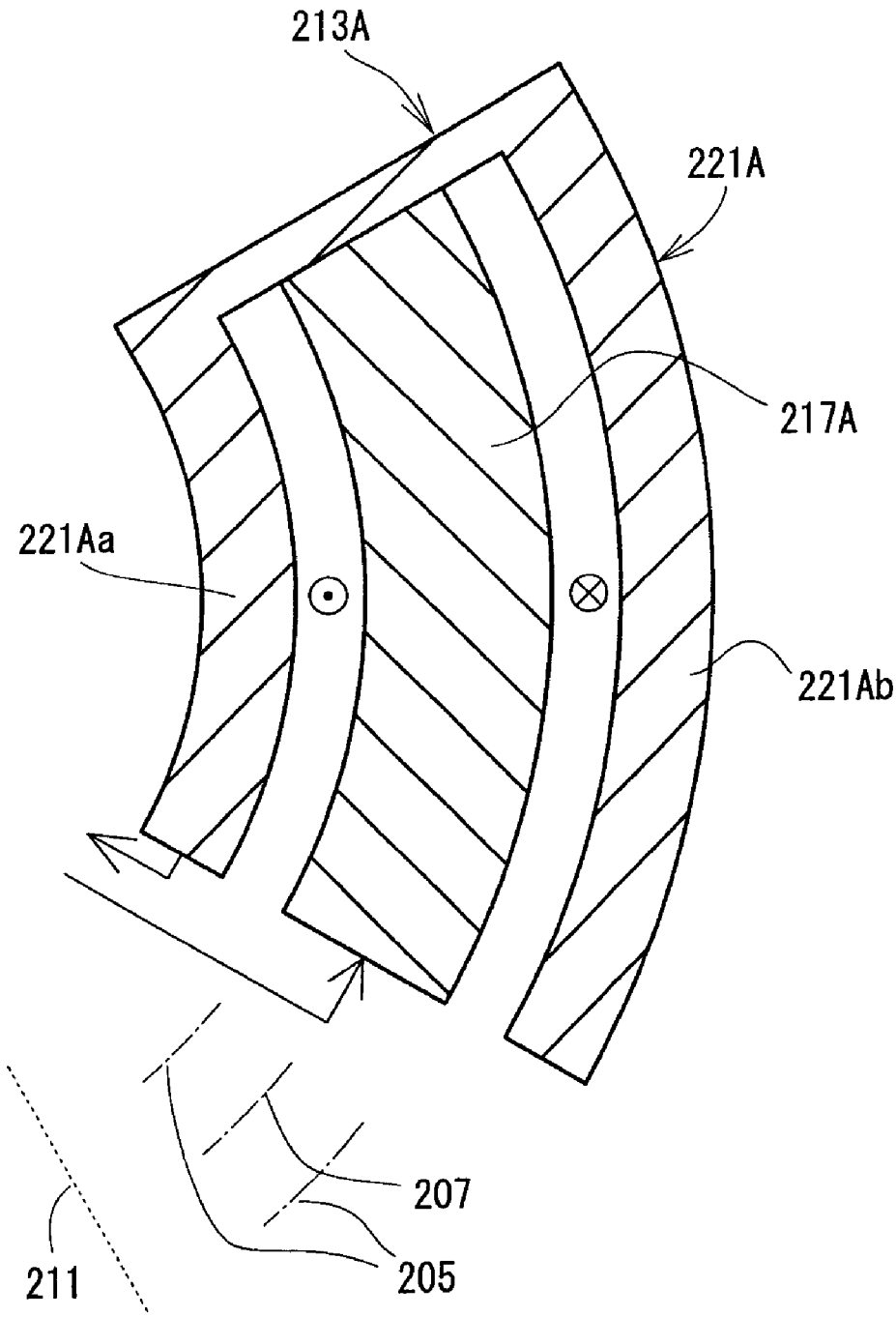
FIG. 8 is a sectional view of the perturbation device for a charged particle circulation system in the second embodiment taken along line X-X in FIG. 7.

FIGS. 7 and 8 show a configuration of a second embodiment of a perturbation device for a charged particle circulation system according to the present invention. FIG. 7 is an end surface view of the perturbation device for a charged particle circulation system in the second embodiment as seen from one side of the device. FIG. 8 is a sectional view of the perturbation device for a charged particle circulation system taken along line X-X in FIG. 7. Reference numerals with 200 added to the reference numerals of components employed in FIGS. 1 through 3 described before are used for components corresponding to the components in FIGS. 1 through 3. The perturbation device 201 for a charged particle circulation system partially superposes a perturbation magnetic field on a main magnetic field, not shown, for circulating charged particles, so that perturbation is produced in the trajectories of the charged particles and the charged particles that have been injected into the charged particle circulation system are thereby captured into a stable circular closed orbit 205.

The magnetic field generation device 202 comprising a high-frequency coils includes a pair of internal conductors 217A and 217B that face each other with a predetermined space 218 through which a part of the stable circular closed orbit 205 passes and an external conductor 213 arranged outside the pair of internal conductors 217A and 2178. The pair of internal conductors 217A and 217B are electrically connected to the external conductor 213 in series. Then, by causing a magnetic field generated between the pair of internal conductors 217A and 217B and the external conductor 213 to leak into the space 218 between the pair of internal conductors 217A and 217B, a leakage magnetic field is formed. A perturbation magnetic field is thereby formed in the space 218. With such configuration, using the leakage magnetic field from the one magnetic field generated by the one magnetic field generation device 202, the perturbation magnetic field may be formed between the pair of internal conductors 217A and 217B. By altering a distribution profile of this leakage magnetic field, a distribution profile of the perturbation magnetic field may be arbitrarily determined.

More specifically, the pair of internal conductors 217A and 217B and the external conductor 213 are configured so that the magnetic field is formed between the pair of internal conductors 217A and 217B and the external conductor 213 so as to surround the pair of internal conductors 217A and 217B and the leakage magnetic field that leaks out of the magnetic field is entered into the space 218 between the pair of internal conductors 217A and 217B. Then, end portions 217Aa, 217Ab, 217Ba, and 217Bb located on both sides of the pair of internal conductors 217A and 217B in a radial direction of the stable circular closed orbit 205 are inclined so that a gap between the end portions 217Aa and 217Ba and a gap between the end portions 217Ab and 217Bb increase more toward the external conductor 213. By inclining the end portions 217Aa, 217Ab, 217Ba, and 217Bb of the pair of internal conductors 217A and 217B in this configuration, the distribution profile of the perturbation magnetic field formed between the pair of internal conductors 217A and 217B may readily be formed into a desired profile.

In this embodiment, the external conductor 213 is configured so that on both sides in the radial direction of the space 218 formed between the pair of internal conductors 217A and 217B, another two spaces 220A and 220B through which charged particles may pass are formed, being aligned with this space 218. Since such another spaces 220A and 220B are formed, the charged particles may be prevented from striking the external conductor and then being lost even if the trajectories of the charged particles greatly vary in the radial direction.

The external conductor 213 in this embodiment includes a first external conductor forming member 213A and a second external conductor forming member 213B that face the pair of internal conductors 217A and 217B, respectively. The first external conductor forming member 213A and the second external conductor forming member 213B are arranged outside the pair of internal conductors 217A and 217B. The first external conductor forming member 213A and the second external conductor forming member 213B are electrically connected, though not shown. The first external conductor forming member 213A and the second external conductor forming member 213B each include an inner surface that faces a corresponding one of the pair of internal conductors 217A and 217B in the radial direction. The first external conductor forming member 213A includes a pair of conductive plates 221Aa and 221Ab located on both sides of the first external conductor forming member 213A in the radial direction. The second external conductor forming member 213B includes a pair of conductive plates 221Ba and 221Bb located on both sides of the second external conductor forming member 213B in the radial direction. The conductive plates 221Aa and 221Ab and the conductive plates 221Ba and 221Bb are located on the both sides of the pair of external conductor forming members 213A and 213B in the radial direction. The conductive plates 221Aa and 221Ba face each other via a gap that forms a passable range 209. The conductive plates 221Ab and 221Bb face each other via the gap that forms a passable range 209. The pair of internal conductors 217A and 217B and the pair of external conductor forming members 213A and 213B are electrically connected in series.

The perturbation device in this embodiment may generate the perturbation magnetic field, using the leakage magnetic field from the magnetic field generated by one magnetic field generation device 201. However, the perturbation magnetic field is generated in the space 218 between the pair of internal conductors 217A and 217B. Thus, when the size of an electron bunch increases, the charged particles will strike the pair of internal conductors 217A and 217B. The perturbation device in this embodiment is therefore suitable for use when the size of the electron bunch is not increased as much as possible.

In the first embodiment described above, the magnetic field generation device is constituted by the first and second divided magnetic field generation devices formed of the high-frequency coils. However, only one of the first and second divided magnetic field generation devices formed of the high-frequency coils may be of course used as the magnetic field generation device formed of the high-frequency coil. In that configuration, the magnetic field generation device may remain unchanged in structure from the first and second divided magnetic field generation devices. Then, this one magnetic field generation device may be arranged adjacent to a space through which a part of a stable circular closed orbit passes.

INDUSTRIAL APPLICABILITY

The perturbation device for a charged particle circulation system according to the present invention utilizes a leakage magnetic field formed of a magnetic field generated by the magnetic field generation device and thereby forms a perturbation magnetic field. Accordingly, by altering the distribution profile of the leakage magnetic field, a desired distribution profile of the perturbation magnetic field may readily be generated.

The invention claimed is:

1. A perturbation device for a charged particle circulation system, which produces perturbation in trajectories of charged particles by partially superposing a perturbation magnetic field on a main magnetic field for circulating the charged particles, and captures the charged particles that have been injected into the charged particle circulation system into a stable circular closed orbit, wherein the perturbation magnetic field is formed of a leakage magnetic field from a magnetic field generated by a magnetic field generation device comprising a high-frequency coil.

2. The perturbation device for a charged particle circulation system according to claim 1, wherein the high-frequency coil has an opening portion that causes the leakage magnetic field to be generated into a space where the perturbation magnetic field is to be formed, and conductor end portions of the high-frequency coil form the opening portion therebetween and are inclined to determine a magnetic field distribution profile of the perturbation magnetic field formed of the leakage magnetic field.

3. The perturbation device for a charged particle circulation system according to claim 1, wherein the high-frequency coil comprises a pair of internal conductors that face each other via a predetermined space through which a part of the stable circular closed orbit passes, and an external conductor arranged outside the pair of the internal conductors;

the pair of internal conductors and the external conductor are electrically connected in series; and the magnetic field generated between the pair of internal conductors and the external conductor is leaked into the space between the pair of internal conductors to form the leakage magnetic field so that the perturbation magnetic field is formed in the space.

4. The perturbation device for a charged particle circulation system according to claim 3, wherein the pair of internal conductors and the external conductor are each configured so that the magnetic field is formed between the pair of internal conductors and the external conductor so as to surround the pair of internal conductors and that the leakage magnetic field leaking out from the magnetic field enters into the space between the pair of internal conductors; and both end portions of each of the pair of internal conductors, located in a radial direction of the stable circular closed orbit, are inclined to determine a magnetic field distribution profile of the perturbation magnetic field formed of the leakage magnetic field.

5. The perturbation device for a charged particle circulation system according to claim 4, wherein the external conductor is configured so that another two spaces where the charged particles may pass are formed and the another two spaces are located on both sides in the radial direction of the space formed in the pair of internal conductors.

6. The perturbation device for a charged particle circulation system according to claim 1, wherein the magnetic field generation device comprises first and second divided magnetic field generation devices each comprising a high-frequency coil;

the first and second divided magnetic field generation devices are arranged apart from each other in the radial direction of the stable circular closed orbit so that a space through which a part of the stable circular closed orbit passes is formed therebetween; and the first and second divided magnetic field generation devices are configured so that the leakage magnetic field is entered into the space and forms the perturbation magnetic field in the space.

7. The perturbation device for a charged particle circulation system according to claim 6, wherein each of the first and second divided magnetic field generation devices comprises:

an internal conductor and an external conductor arranged apart from each other and electrically connected in series; and the internal conductor and the external conductor are configured so that the magnetic field is formed therebetween, and the leakage magnetic field is leaked from an opening portion formed in the external conductor and opened in the radial direction.

8. The perturbation device for a charged particle circulation system according to claim 7, wherein the external conductor used in each of the first and second divided magnetic field generation devices includes a pair of conductor end portions which are located on both sides of the opening portion and the pair of conductor end portions are inclined to determine a magnetic field distribution profile of the perturbation magnetic field formed of the leakage magnetic field.

9. The perturbation device for a charged particle circulation system according to claim 7, wherein the internal conductor comprises a pair of divided internal conductors spaced in an orthogonal direction orthogonal to both a peripheral direction of the stable circular closed orbit and the radial direction of the stable circular closed orbit;

the external conductor with the opening portion opened in the radial direction, is formed so as to surround the pair of divided internal conductors and is opened on both ends of the stable circular closed orbit in the peripheral direction; and the pair of divided internal conductors and the external conductor are positioned so that a gap formed between the pair of divided internal conductors and the opening portion are aligned in the radial direction of the stable circular closed orbit.

10. The perturbation device for a charged particle circulation system according to claim 9, wherein the first divided magnetic field generation device is arranged more inward in the radial direction of the stable circular closed orbit than the second divided magnetic field generation device;

the pair of divided internal conductors of the first divided magnetic field generation device comprises a pair of circular arc-like conductive plates that extend along the peripheral direction and in the radial direction, centering on the center of the stable circular closed orbit, the pair of circular arc-like conductive plates being located inside the stable circular closed orbit;

the external conductor of the first divided magnetic field generation device comprises:

a pair of circular arc-like conductive plates located on both sides of the opening portion and spaced in the orthogonal direction, the pair of circular arc-like conductive plates respectively extending in the peripheral direction, centering on the center of the stable circular closed orbit, and also extending in the orthogonal direction;

a pair of conductive side plates located outside the pair of divided internal conductors, the conductive side plates being spaced in the orthogonal direction and extending in the peripheral direction and in the radial direction, each of the pair of conductive side plates having an end portion located outward in the radial direction, on which-the circular arc-like conductive plate is arranged; and a conductive coupling plate that couples end portions of the pair of conductive side plates, which are located inward in the radial direction;

a conductive short-circuit plate couples the pair of divided internal conductors and the external conductor at a position that does not interfere with passage of the charged particles;

the pair of divided internal conductors of the second divided magnetic fiE;ld generation device comprises a pair of circular arc-likE; conductive plates that extends along the peripheral direction and in the radial direction, centering on the center of the stable circular closed orbit, the pair of circular arc-like conductive plates being located outside the stable circular closed orbit;

the external conductor of the second divided magnetic field generation device comprises:

a pair of circular arc-like conductive plates located on both sides of the opening portion, the circular arc-like conductive plates being spaced in the orthogonal direction, the circular arc-like conductive plates extending in the peripheral direction, centering on the center of the stable circular closed orbit, and also extending in the orthogonal direction;

a pair of conductive side plates located outside the pair of divided internal conductors, the conductive side plates being spaced in the orthogonal direction and extending in the peripheral direction and in the radial direction, each of the pair of conductive side plates having an end portion located outward in the radial direction, on which-the circular arc-like conductive plate is arranged; and a conductive coupling plate that couples end portions of the pair of conductive side plates, which are located outward in the radial direction; and a conductive short-circuit plate couples the pair of divided internal conductors and the external conductor at a position that does not interfere with passage of the charged particles.

11. The perturbation device for a charged particle circulation system according to claim 9, wherein the first divided magnetic field generation device is arranged more inward in the radial direction of the stable circular closed orbit than the second divided magnetic field generation device;

the pair of divided internal conductors of the first divided magnetic field generation device comprises a pair of circular arc-like conductive plates that extend along the peripheral direction and in the radial direction, centering on the center of the stable circular closed orbit, the pair of circular arc-like conductive plates being located inside the stable circular closed orbit;

the external conductor of the first divided magnetic field generation device comprises:

a pair of circular arc-like conductive plates located on both sides of the opening portion in the orthogonal direction, the pair of circular arc-like conductive plates respectively extending in the peripheral direction, centering on the center of the stable circular closed orbit, and also extending in the orthogonal direction;

a pair of conductive side plates located outside the pair of divided internal conductors, the conductive side plates being spaced in the orthogonal direction and extending in the peripheral direction and in the radial direction, each of the pair of conductive side plates having an end portion located outward in the radial direction, on which the circular arc-like conductive plate is arranged; and a conductive coupling plate that couples end portions of the pair of conductive side plates, which are located inward in the radial direction;

the pair of divided internal conductors of the second divided magnetic field generation device comprises a pair of circular arc-like conductive plates that extends along the peripheral direction and in the radial direction, centering on the center of the stable circular closed orbit, the pair of circular arc-like conductive plates being located outside the stable circular closed orbit; and the external conductor of the second divided magnetic field generation device comprises:

a pair of circular arc-like conductive plates located on both sides of the opening portion, the circular arc-like conductive plates being spaced in the orthogonal direction, the circular arc-like conductive plates extending in the peripheral direction, centering on the center of the stable circular closed orbit, and also extending in the orthogonal direction;

a pair of conductive side plates located outside the pair of divided internal conductors, the conductive side plates being spaced in the orthogonal direction and extending in the peripheral direction and in the radial direction, each of the pair of conductive side plates having an end portion located outward in the radial direction, on which the circular arc-like conductive plate is arranged; and a conductive coupling plate that couples end portions of the pair of conductive side plates, which are located outward in the radial direction;

wherein the pair of divided internal conductors of the first divided magnetic field generation device and the pair of divided internal conductors of the second divided magnetic field generation device are electrically connected in series, and the external conductor of the first divided magnetic field generation device and the external conductor of the second divided magnetic field generation device are electrically connected in series.

12. The perturbation device for a charged particle circulation system according to claim 1, wherein the magnetic field generation device is arranged adjacent to a space through which the stable circular closed orbit passes; and the magnetic field generation device is configured so that the leakage magnetic field enters into the space, and forms the perturbation magnetic field in the space.

13. The perturbation device for a charged particle circulation system according to claim 12, wherein the magnetic field generation device includes an internal conductor and an external conductor arranged apart from each other and electrically connected in series; and the internal conductor and the external conductor are configured so that the magnetic field is formed therebetween, and the leakage magnetic field is leaked from an opening portion formed in the external conductor and opened in the radial direction.

14. The perturbation device for a charged particle circulation system according to claim 13, wherein the external conductor used in the magnetic field generation device has a pair of conductor end portions located on both sides of the opening portion, and the conductor end portions are inclined to determine a magnetic field distribution profile of the perturbation magnetic field formed of the leakage magnetic field.

15. The perturbation device for a charged particle circulation system according to claim 13, wherein the internal conductor comprises a pair of divided internal conductors spaced in an orthogonal direction orthogonal to both a peripheral direction of the stable circular closed orbit and the radial direction of the stable circular closed orbit;

the external conductor with the opening portion opened in the radial direction is formed so as to surround the pair of divided internal conductors and is opened on both ends of the stable circular closed orbit in the peripheral direction; and the pair of divided internal conductors and the external conductor are positioned so that a gap formed between the pair of divided internal conductors and the opening portion are aligned in the radial direction.

* * * * *